US008538762B2

(12) United States Patent
Moon et al.

(10) Patent No.: US 8,538,762 B2
(45) Date of Patent: Sep. 17, 2013

(54) METHOD AND APPARATUS FOR ENCODING/DECODING STEREO AUDIO

(75) Inventors: Han-gil Moon, Seoul (KR); Geon-hyoung Lee, Hwaseong-si (KR); Chul-woo Lee, Suwon-si (KR); Jong-hoon Jeong, Suwon-si (KR); Nam-suk Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 854 days.

(21) Appl. No.: 12/389,639

(22) Filed: Feb. 20, 2009

(65) Prior Publication Data

US 2009/0210236 A1 Aug. 20, 2009

(30) Foreign Application Priority Data

Feb. 20, 2008 (KR) ..... 10-2008-0015445

(51) Int. Cl.
*G10L 19/00* (2013.01)

(52) U.S. Cl.
USPC ..... 704/500; 704/504; 704/501

(58) Field of Classification Search
USPC ..... 704/500–504, 219–230; 381/20, 381/23
See application file for complete search history.

(56) References Cited

U.S. PATENT DOCUMENTS

| | | | | |
|---|---|---|---|---|
| 7,181,019 | B2 * | 2/2007 | Breebaart et al. | 381/23 |
| 7,933,415 | B2 * | 4/2011 | Breebaart | 381/20 |
| 2006/0133618 | A1 | 6/2006 | Villemoes et al. | |
| 2007/0127729 | A1 | 6/2007 | Breebaart et al. | |

FOREIGN PATENT DOCUMENTS

WO 03/007656 A1 1/2003

* cited by examiner

*Primary Examiner* — Huyen X. Vo
(74) *Attorney, Agent, or Firm* — Sughrue Mion, PLLC

(57) ABSTRACT

Provided are a method and apparatus for encoding/decoding stereo audio. In the method for encoding stereo audio, stereo audio is encoded based on at least one of the phase difference between first and second channel audios and information on an angle made by a vector on the intensity of mono-audio and a vector on the intensity of the first channel audio or a vector on the intensity of the second channel audio. Thus, the number of encoded parameters is minimized so that a compression ratio in the encoding of the stereo audio is improved.

13 Claims, 5 Drawing Sheets

METHOD AND APPARATUS FOR ENCODING/DECODING STEREO AUDIO

CROSS-REFERENCE TO RELATED PATENT APPLICATIONS

This application claims priority from Korean Patent Application No. 10-2008-0015445, filed on Feb. 20, 2008, in the Korean Intellectual Property Office, the disclosure of which is incorporated herein in its entirety by reference.

BACKGROUND OF THE INVENTION

1. Field of the Invention

Apparatuses and methods consistent with the present invention relate to encoding/decoding stereo audio, and more particularly, to parametrically encoding/decoding stereo audio by minimizing the number of parameters needed for the encoding/decoding of stereo audio.

2. Description of the Related Art

In general, a method of encoding multichannel audio includes waveform audio coding and parametric audio coding. The waveform encoding includes MPEG-2 MC audio coding, AAC MC audio coding, and BSAC/AVS MC audio coding.

In the parametric audio coding, an audio signal is encoded by dividing the audio signal into components such as frequency or amplitude and parameterizing information on the frequency or amplitude. For example, when stereo audio is encoded using the parametric audio coding, left channel audio and right channel audio are downmixed to generate mono audio and the generated mono audio is encoded. Then, parameters about interchannel intensity difference (IID), interchannel correlation (ICC), overall phase difference (OPD), and interchannel phase difference (IPD) needed for restoring the mono audio to stereo audio are encoded.

The parameters on the interchannel intensity difference and the interchannel correlation are encoded as information for determining the intensity of the left channel audio and the right channel audio. The parameters on the overall phase difference and the interchannel phase difference are encoded as information for determining the phase of the left channel audio and the right channel audio.

Many studies have been made on a method of efficiently encoding mono audio so that the mono audio may be encoded at a high compression rate. However, to efficiently encode stereo audio, not only the mono audio but also the above-described parameters of stereo audio need to be efficiently compressed and encoded.

SUMMARY OF THE INVENTION

To address the above and/or other problems, the present invention provides a method and apparatus for encoding/decoding stereo audio which may efficiently encode/decode parameters of the stereo audio.

Also, the present invention provides a computer readable recording medium recording a program for implementing the above method.

According to an aspect of the present invention, a method of encoding stereo audio comprises generating a phase-adjusted second channel audio by adjusting the phase of a second channel audio such that the phase of a first channel audio and the phase of the second channel audio are the same in a predetermined frequency band, generating mono-audio by adding the first channel audio and the phase-adjusted second channel audio, and encoding the stereo audio based on the mono-audio and information on a phase difference between the first and second channel audios in the frequency band.

According to another aspect of the present invention, a method of decoding stereo audio comprises restoring mono-audio by decoding audio data on the stereo audio, extracting information for determining the intensities of first and second channel audios and information on a phase difference between the first and second channel audios in a predetermined frequency band by decoding the audio data, and restoring the stereo audio in the frequency band based on the restored mono-audio and the extracted information, wherein the mono-audio is generated by adding the first channel audio and a phase-adjusted second channel audio whose phase is adjusted to be the same as the phase of the first channel audio.

According to another aspect of the present invention, a method of decoding stereo audio comprises generating information on an angle between a first vector on the intensity of a first channel audio in a frequency band and a third vector on the intensity of mono-audio or an angle between a second vector on the intensity of a second channel audio in the frequency band and the third vector in a vector space in which the first vector and the second vector make a predetermined angle, and encoding the stereo audio based on the mono-audio and information on the generated angle, wherein the third vector is generated by adding the first and second vectors in the vector space.

According to another aspect of the present invention, a method of decoding stereo audio comprises restoring mono-audio by decoding audio data on the stereo audio, extracting information for determining the intensities of first and second channel audios and information for determining the phase of the first and second channel audios in a predetermined frequency band by decoding the audio data, and restoring the stereo audio based on the restored mono-audio and the extracted information, wherein the information for determining the intensities of the first and second channel audios is information on an angle between a first vector on the intensity of a first channel audio in a frequency band and a third vector on the intensity of mono-audio or an angle between a second vector on the intensity of a second channel audio in the frequency band and the third vector in a vector space in which the first vector and the second vector make a predetermined angle.

According to another aspect of the present invention, an apparatus for decoding stereo audio comprises a mono-audio decoding unit restoring mono-audio in a frequency band by decoding audio data on the stereo audio, a parameter decoding unit extracting information on a phase difference between first and second channel audios in the frequency band and information for determining the intensities of the first and second channel audios, by decoding the audio data, and an audio restoration unit restoring the stereo audio based on the restored mono-audio and the extracted information, wherein the mono-audio is generated by adding the first channel audio and a phase-adjusted second channel audio whose phase is adjusted to be the same as the phase of the first channel audio.

According to another aspect of the present invention, an apparatus for encoding stereo audio comprises a downmix unit generating mono-audio by adding first and second channel audios in a predetermined frequency band, a parameter encoding unit encoding information on an angle between a first vector on the intensity of the first channel audio in the frequency band and a third vector on the intensity of the mono-audio or an angle between a second vector on the intensity of the second channel audio in the frequency band and the third vector in a vector space in which the first vector and the second vector make a predetermined angle, and a mono-audio encoding unit encoding the mono-audio, wherein the third vector is generated by adding the first and second vectors in the vector space.

According to another aspect of the present invention, an apparatus for decoding stereo audio comprises a mono-audio decoding unit restoring mono-audio by decoding audio data on the stereo audio, a parameter decoding unit extracting information for determining the phases of the first and second channel audios in the frequency band and information for determining the intensities of the first and second channel audios in a frequency band, by decoding the audio data, and an audio restoration unit restoring the stereo audio based on the restored mono-audio and the extracted information, wherein the information for determining the intensities of the first and second channel audios is information on an angle between a first vector on the intensity of the first channel audio in the frequency band and a third vector on the intensity of the mono-audio or an angle between a second vector on the intensity of the second channel audio in the frequency band and the third vector in a vector space in which the first vector and the second vector make a predetermined angle.

According to another aspect of the present invention, a computer-readable recording medium recording a program to execute one of the above methods.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF EXEMPLARY EMBODIMENTS OF THE INVENTION

Figure 1:
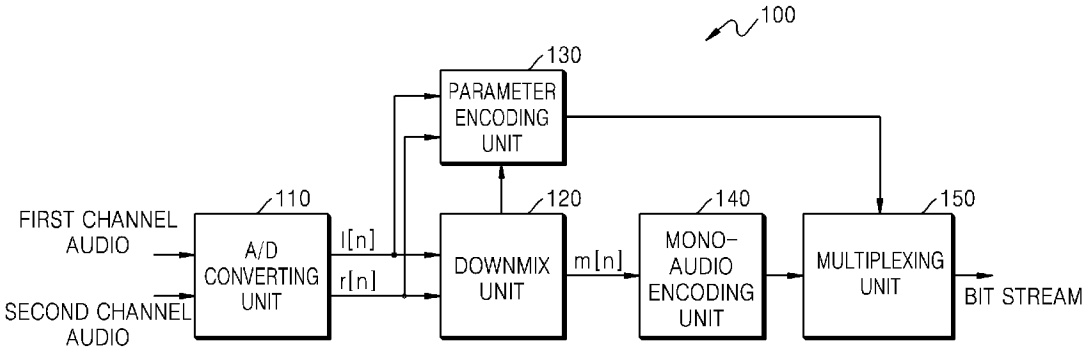
FIG. 1 is a block diagram of an apparatus for encoding stereo audio according to an embodiment of the present invention.

The attached drawings for illustrating exemplary embodiments of the present invention are referred to in order to gain a sufficient understanding of the present invention, the merits thereof, and the objectives accomplished by the implementation of the present invention. Hereinafter, the present invention will be described in detail by explaining exemplary embodiments of the invention with reference to the attached drawings. Like reference numerals in the drawings denote like elements.

FIG. 1 is a block diagram of an apparatus for encoding stereo audio according to an embodiment of the present invention. Referring to FIG. 1, a stereo audio encoding apparatus 100 according to an embodiment of the present invention includes an A/D converting unit 110, a downmix unit 120, a parameter encoding unit 130, a mono-audio encoding unit 140, and a multiplexing unit 150.

The A/D converting unit 110 receives an analog signal of a first channel audio and an analog signal of a second channel audio and converts each of the first and second channel audios to a digital signal by sampling and quantizing the analog signals. In the present embodiment, it is assumed that the first channel audio is a left channel audio and the second channel audio is a right channel audio.

The downmix unit 120 generates mono-audio by adding the first channel audio and the second channel audio which are converted to the digital signals by the A/D converting unit 110. In the method of encoding stereo audio according to the present embodiment, without adding the first and second channel audios as they are, a phase-adjusted second channel audio is generated by adjusting the phase of the second channel audio and the phase-adjusted second channel audio is added to the first channel audio so that mono-audio is generated which will be described in detail later.

The parameter encoding unit 130 generates parameters of a stereo audio based on the first and second channel audios digitalized by the A/D converting unit 110 and the mono-audio received from the down-mix unit 120. The parameters are information needed to restore the first and second channel audios from the mono-audio by performing decoding at a side where stereo audio is decoded. The parameters include information for determining the phases of the first and second channel audios and information for determining the intensities of the first and second channel audios. The generation of the parameters is described below for cases of encoding information for determining the intensities of the first and second channel audios and information for determining the phases of the intensities of the first and second channel audios.

(1) Information for Determining Intensity

In a parametric audio coding, each of channel audios is converted to a frequency domain and information on the intensity and phase of each channel audio in the frequency domain is encoded. The parametric audio coding is described in detail with reference to FIG. 2.

Figure 2:
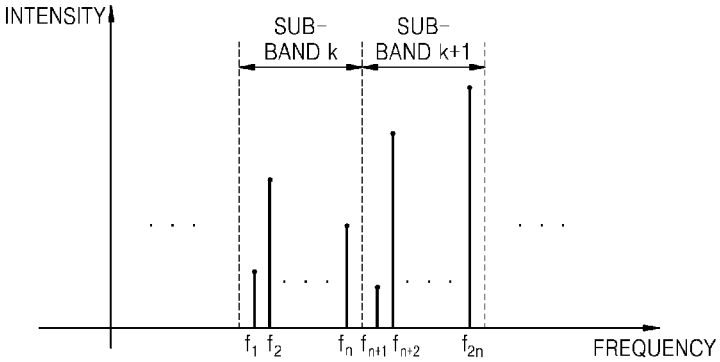
FIG. 2 is a graph showing sub-bands in the parametric audio coding.

FIG. 2 is a graph showing sub-bands in the parametric audio coding. In FIG. 2, a frequency spectrum obtained by converting an audio signal to a frequency domain is shown. When an audio signal is fast-Fourier-transformed, the audio signal is presented by discrete values in the frequency domain. That is, the audio signal is presented as a sum of a plurality of sinusoidal waves.

In the parametric audio coding, when the audio signal is converted to the frequency domain, the frequency domain is divided into a plurality of sub-bands. In each sub-band, the information for determining the intensities of the first and second channel audios and the information for determining the phases of the first and second channel audios are encoded. Parameters on the intensity and phase of a sub-band k are encoded. Also, parameters on the intensity and phase of a sub-band k+1 are encoded. An overall frequency band is divided into a plurality of sub-bands and a stereo audio parameter is encoded for each sub-band. A case of encoding parameters on the first and second channel audios in a predetermined frequency band, that is, the sub-band k, in connection with the encoding and decoding of the stereo audio, is described below.

In the above-described conventional parametric audio coding, when the stereo audio is encoded, information on the interchannel intensity difference (IID) and the interchannel correlation (ICC) is encoded as the information for determining the intensities of the first and second channel audios in the sub-band k.

In the sub-band k, each of the intensities of the first and second channel audios is calculated and the ratio between the intensity of the first channel audio and the intensity of the second channel audio are encoded as information on the IID. However, since the intensities of the first and second channel audios cannot be determined at a side for decoding with only the ratio between the intensities of the two channel audios, information on the ICC is encoded together as additional information and inserted in a bit stream.

In the stereo audio encoding method of the present embodiment, a vector on the intensity of the first channel audio and a vector on the intensity of the second channel audio in the sub-band k are used to minimize the number of the parameters encoded as the information for determining the intensities of the first and second channel audios in the sub-band k. The average of the intensities of frequencies, $f_1, f_2, \ldots, f_n$, in the frequency spectrum obtained by converting the first channel audio to the frequency domain is the intensity of the first channel audio in the sub-band k and the magnitude of a vector L that will be described later. Likewise, the average of the intensities of frequencies, $f_1, f_2, \ldots, f_n$, in the frequency spectrum obtained by converting the first channel audio to the frequency domain is the intensity of the second channel audio in the sub-band k and the magnitude of a vector R that will be described later. The above-described method will be described in detail with reference to FIGS. 3A and 3B.

Figure 3A:
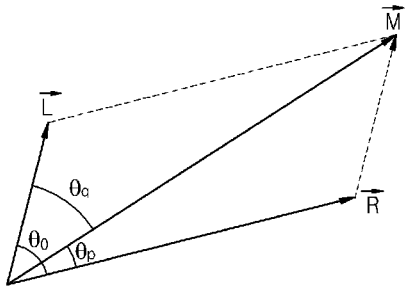
FIG. 3A shows a vector space according to an embodiment of the present invention.

FIG. 3A shows a vector space according to an embodiment of the present invention. Referring to FIG. 3A, the parameter encoding unit 130 of the present embodiment generates a two dimensional vector space in which the vector L on the intensity of the first channel audio and the vector R on the intensity of the second channel audio in the sub-band k make a predetermined angle. Since it is common to encode the stereo audio based on an assumption that a listener listens the stereo audio at a position where a left sound source and a right sound source make an angle of 60°, an angle $\theta_0$ between the vector L and the vector R in the two dimensional vector space may be set to 60°. A vector M on the intensity of the mono-audio in the two dimensional vector space generated by the vector L on the intensity of the first channel audio and the vector R on the intensity of the second channel audio is presented as a sum of the vector L and the vector R.

The parameter encoding unit 130 of the present embodiment encodes information on an angle $\theta_q$ between the vector M and the vector L or an angle $\theta_p$ between the vector M and the vector R, instead of the information on the IID and the information on the ICC, as the information for determining the intensities of the first and second channel audios in the sub-band k.

Also, instead of encoding the angle $\theta_q$ between the vector M and the vector L or the angle $\theta_p$ between the vector M and the vector R, a cosine value such as $\cos(\theta_q)$ or $\cos(\theta_p)$ may be encoded. In order to encoding the information on an angle and insert the encoded information in a bit stream, a quantization process must be performed. In doing so, the cosine value of the angle is encoded to minimize a loss generated in the quantization process.

Figure 3B:
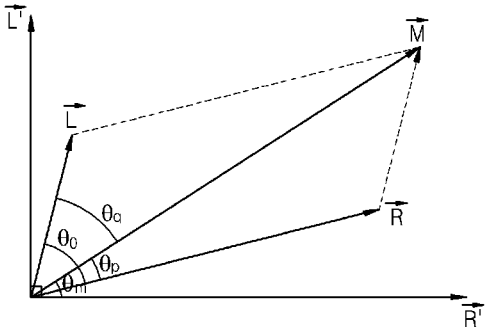
FIG. 3B shows the normalization of a vector angle according to an embodiment of the present invention.

FIG. 3B shows the normalization of a vector angle according to an embodiment of the present invention. As shown in FIG. 3A, when the angle $\theta_0$ between the vector L on the intensity of the first channel audio and the vector R on the intensity of the second channel audio is not 90°, the angle $\theta_0$ may be normalized to 90° and the angle $\theta_q$ or $\theta_p$ is normalized as well. The unnormalized angle $\theta_0$ may be set to 60° and an angle between the vector L and the vector L' and an angle between the vector R and the vector R' may be equal. In the case in which the information on the angle $\theta_p$ between the vector M and the vector R is encoded in the parameter encoding unit 130, when the angle $\theta_0$ is normalized to 90°, the angle $\theta_p$ is normalized so that a normalized angle $\theta_m$ ($\theta_m=(\theta_p\times 90)/\theta_0$) is calculated. Then, the parameter encoding unit 130 encodes $\cos(\theta_m)$ and insert the encoded $\cos(\theta_m)$ in the bit stream.

(2) Information for Determining Phase

In the conventional parametric audio coding, as described above, the information on the OPD and the IPD are encoded as the information for determining the phases of the first and second channel audios in the sub-band k. For example, the information on the OPD is generated and encoded by calculating a phase difference between the first channel audio in the sub-band k and the mono-audio generated by adding the first channel audio and the second channel audio in the sub-band k. The information on the IPD is generated and encoded by calculating a phase difference between the first and second channel audios in the sub-band k. The phase difference may be obtained by calculating each of the phase differences at the frequencies $f_1, f_2, \ldots, f_n$ included in the sub-band and calculating the average of the calculated phase differences.

However, in the stereo audio encoding method according to the present embodiment, the parameter encoding unit 130 encodes only the information on the phase difference between the first channel audio and the second channel audio in the sub-band k as the information for determining the phases of the first and second channel audios.

The downmix unit 120 generates a phase-adjusted second channel audio by adjusting the phase of the second channel audio to be the same as the phase of the first channel audio. In the generation of the mono-audio, not the original second channel audio but the phase-adjusted second channel audio is added to the first channel audio. For example, in the audio in the sub-band k, the phases of the second channel audios at the frequencies $f_1, f_2, \ldots, f_n$ are respectively adjusted to be the same as those of the first channel audios at the frequencies $f_1, f_2, \ldots, f_n$. In the case that the phase of the first channel audio at the frequency $f_1$ is adjusted, when the first channel audio L is $|L|e^{i(2\pi f_1 t+\theta_1)}$ and the second channel audio R is $|R|e^{i(2\pi f_1 t+\theta_2)}$ at the frequencies $f_1$, the phase-adjusted second channel audio R' at the frequency $f_1$ may be obtained by the following equation. Here, "$\theta_1$" is the phase of the first channel audio at the frequency $f_1$ and "$\theta_2$" is the phase of the second channel audio at the frequency $f_1$.

$$R'=R\times e^{i(\theta_1-\theta_2)}=|R|e^{i(2\pi f_1 t+\theta_1)} \quad \text{[Equation 1]}$$

The phase of the second channel audio R at the frequency $f_1$ is adjusted according to Equation 1 so as to be the same as that of the first channel audio L. The phase adjustment is repeated for the second channel audio at different frequencies of the sub-band k, that is, $f_2, f_3, \ldots, f_n$, so that the phase-adjusted second channel audio in the sub-band k is generated.

Since the phase-adjusted second channel audio in the sub-band k has the same phase as the first channel audio, the phase of the second channel audio may be obtained at the side where the stereo audio is decoded, by encoding only the phase difference between the first and second channel audios. Also, since the phase of the first channel audio and the phase of the mono-audio generated by the downmix unit 120 are the same, there is no need to separately encode the information on the phase of the first channel audio.

Since the mono-audio generated by adding the phase of the first channel audio and the phase-adjusted second channel audio has the same phase as the first channel audio, the phase of the first channel audio can be restored at the decoding side without encoding the information on the phase of the first channel audio. The information on the phase difference between the first channel audio and the second channel audio needed for obtaining the phase of the second channel audio from the first channel audio is encoded.

The method of encoding information for determining the intensities of the first and second channel audios using the intensity vectors of channel audios in the sub-band k and the method of encoding information for determining the phases of the first and second channel audios in the sub-band k by adjusting the phase may be independently used or used in a combination. In other words, the information for determining the intensities of the first and second channel audios is encoded using a vector according to the present embodiment. The information for determining the phases of the first and second channel audios may be encoded using the OPD and the IPD like the conventional technology. In contrast, the information for determining the intensities of the first and second channel audios is encoded using the IID and the ICC according to the conventional technology. Only the information for determining the phases of the first and second channel audios may be encoded using the phase adjustment as in the present embodiment. Also, stereo audio may be encoded using both of the above-described methods according to the present embodiment.

Referring back to FIG. 1, the mono-audio encoding unit 140 encodes mono-audio generated by the downmix unit 120. There is no limit in encoding the mono-audio and the mono-audio may be encoded in a general encoding method used for encoding the mono-audio. The mono-audio may be generated by adding the first channel audio and the original second channel audio, or the first channel audio and the phase-adjusted second channel audio.

The multiplexing unit 150 receives and multiplexes a bit stream of the parameters generated by the parameter encoding unit 130 and a bit stream of the mono-audio generated by the mono-audio encoding unit 140.

Figure 4:
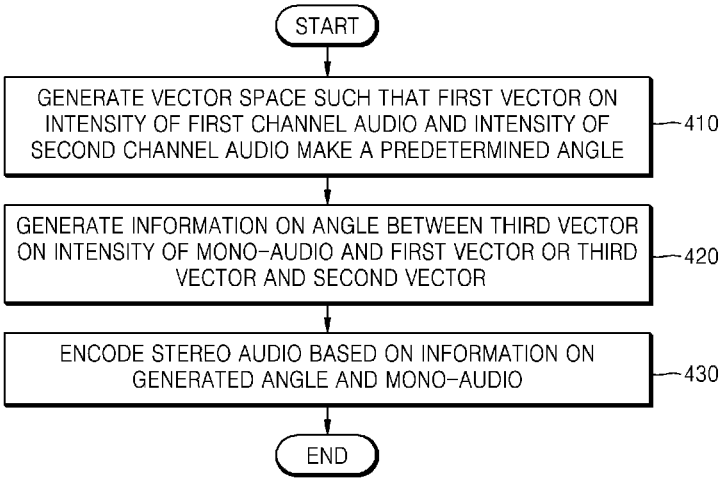
FIG. 4 is a flowchart for explaining a method of encoding stereo audio according to an embodiment of the present invention.

FIG. 4 is a flowchart for explaining a method of encoding stereo audio according to an embodiment of the present invention. In FIG. 4, a method of encoding the information on the intensities of the first and second channel audios in a predetermined frequency band, that is, the sub-band k, according to an embodiment of the present invention is described.

In Operation 410, the stereo audio encoding apparatus according to the present embodiment generates a vector space such that the first vector on the intensity of the first channel audio and the second vector on the intensity of the second channel audio make a predetermined angle in the sub-band k. The stereo audio encoding apparatus generates a vector space shown in FIG. 3A based on the intensities of the first and second channel audios in the sub-band k. The predetermined angle may be 60°.

In Operation 420, the stereo audio encoding apparatus generates the third vector on the intensity of the mono-audio by adding the first and second vectors in the vector space. Then, the stereo audio encoding apparatus generates information on an angle between the first vector and the third vector or between the second vector and the third vector. The mono-audio may be generated by adding the first channel audio and the original second channel audio, or the first channel audio and the phase-adjusted second channel audio. The phase of the phase-adjusted second channel audio is the same as the phase of the first channel audio in the sub-band k.

In Operation 430, the stereo audio encoding apparatus encodes stereo audio based on the information on the angle generated in Operation 420 and the mono-audio. The mono-audio is encoded in a general audio encoding method and the information on the angle generated in Operation 420 is encoded to a predetermined bit stream. The information on the angle may be information on a cosine value of the angle, not the angle itself The information on the angle generated in Operation 420 is information for determining the intensities of the first and second channel audios in the sub-band k.

The information for determining the phases of the first and second channel audios in the sub-band k is encoded. The information may be encoded based on the OPD and the IPD according to the conventional technology. As described above, only the information on the phase difference between the first and second channel audios in the sub-band k may be encoded. When the mono-audio is generated by adding the first channel audio and the phase-adjusted second channel audio, only the information on the phase difference between the first and second channel audios may be encoded according the present embodiment.

Figure 5:
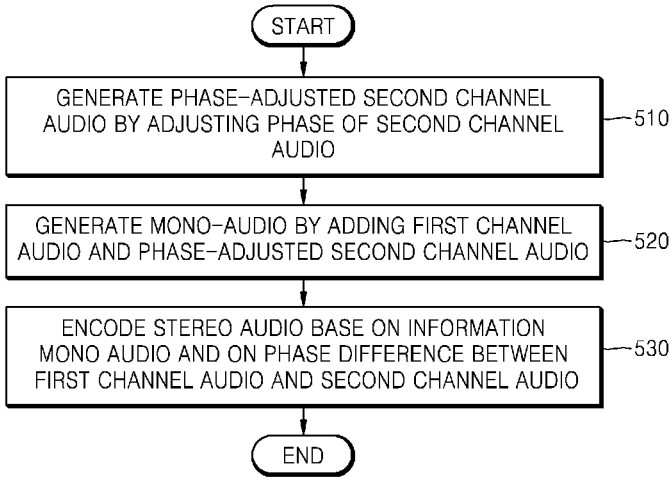
FIG. 5 is a flowchart for explaining a method of encoding stereo audio according to another embodiment of the present invention.

FIG. 5 is a flowchart for explaining a method of encoding stereo audio according to another embodiment of the present invention. In FIG. 5, a method of encoding information for determining the phases of the first and second channel audios of stereo audio in the sub-band k according to the present embodiment is described.

Referring to FIG. 5, in Operation 510, the stereo audio encoding apparatus generates a phase-adjusted second channel audio by adjusting the phase of the second channel audio in the sub-band k. The phase of the second channel audio is adjusted to be the same as that of the first channel audio to encode only the phase difference between the first and second channel audios in the sub-band k as the information for determining the phases of the first and second channel audios in the sub-band k.

Since the phases of the first and second channel audios in the sub-band k are the same, the phase of the mono-audio in the sub-band k generated by adding the first channel audio and the phase-adjusted second channel audio is the same as that of the first channel audio. Thus, when only the information on the phase difference between the first and second channel audios is decoded at the decoding side, both of the phases of the first and second channel audios may be restored.

In Operation 520, the stereo audio encoding apparatus generates mono-audio by adding the first channel audio and the phase-adjusted second channel audio. The mono-audio is generated by adding the first channel audio and the second channel audio whose phase is adjusted to be the same as the phase of the first channel audio in Operation 5 10.

In Operation 530, the stereo audio encoding apparatus encodes stereo audio based on the information on the phase difference between the first and second channel audios and the mono-audio generated in Operation 520. The mono-audio is encoded in a general audio encoding method. However, only the information on the phase difference between the first and second channel audios in the sub-band k as the information on the phases of the first and second channel audios in the sub-band k.

The information on the IID and the ICC may be encoded according to the conventional technology as the information for determining the intensities of the first and second channel audios in the sub-band k. Also, the information on the angle made by the vector on the intensity of the mono-audio and the vector on the intensity of the first channel audio or the angle made by the vector on the intensity of the mono-audio and the vector on the intensity of the second channel audio in the vector space generated using the vector on the intensity of the first channel audio and the vector on the second channel audio according to the present embodiment.

Figure 6:
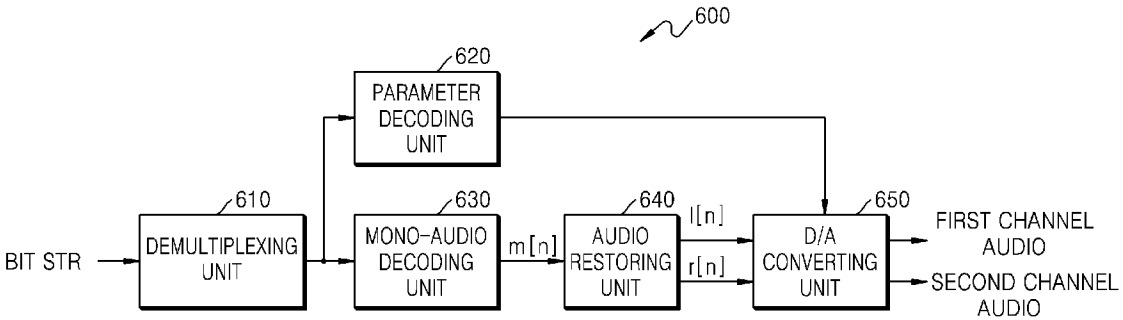
FIG. 6 is a block diagram of an apparatus for decoding stereo audio according to an embodiment of the present invention.

FIG. 6 is a block diagram of an apparatus for decoding stereo audio according to an embodiment of the present invention. Referring to FIG. 6, a stereo audio decoding apparatus 600 according to the present embodiment includes a demultiplexing unit 610, a parameter decoding unit 620, a mono-audio decoding unit 630, an audio restoration unit 640, and a D/A converting unit 650.

The demultiplexing unit 610 receives a bit stream of stereo audio and demultiplexes the received bit stream to decompose and extract a bit stream of mono-audio and a bit stream of stereo audio parameters. The parameter decoding unit 620 receives the bit stream of the stereo audio parameters from the demultiplexing unit 610 and decodes information for determining the intensities of the first and second channel audios in the sub-band k and information for determining the phases of the first and second channel audios in the sub-band k.

In the vector space shown in FIG. 3A, as the information for determining the intensities of the first and second channel audios in the sub-band k, the information on an angle made between a vector (the vector M) on the intensity of the mono-audio included in the bit stream of the stereo audio and a vector (the vector L) on the intensity of the first channel audio or a vector (the vector R) on the intensity of the second channel audio is decoded. Preferably, information on a cosine value of the angle between the vector M and the vector L, or the vector M and the vector R may be received and decoded.

Also, the parameter decoding unit 620 may decode only the information on the phase difference between the first and second channel audios as the information for determining the phases of the first and second channel audios in the sub-band k. In the encoding of the stereo audio, when the phase of the second channel audio is already adjusted to be the same as the phase of the first channel audio, the audio restoration unit 640 which will be described later may restore the phases of the first and second channel audios as the parameter decoding unit 620 decodes only the information on the phase difference between the first and second channel audios.

The mono-audio decoding unit 630 decodes the bit stream of the mono-audio received from the demultiplexing unit 610 and restores the mono-audio in a predetermined frequency band. The mono-audio is decoded in a decoding method reverse to the encoding method used for encoding the mono-audio in the stereo audio encoding apparatus.

The audio restoration unit 640 restores stereo audio in a predetermined frequency band based on the stereo audio parameters decoded by the parameter decoding unit 620 and the mono-audio decoded by the mono-audio decoding unit 630. The audio restoration unit 640 converts the mono-audio decoded by the mono-audio decoding unit 630 to stereo audio using the information for determining the intensities of the first and second channel audios decoded by the parameter decoding unit 620 and the information for determining the phases of the first and second channel audios.

The intensities of the first and second channel audios are restored based on the information on the angle between the vector M and the vector L or the information on the angle between the vector M and the vector R which is described above. Information on $\cos(\theta_m)$ based on $\theta_m$ that is normalized in an example shown in FIG. 3B is decoded by the parameter decoding unit 620 is described below.

The intensity of the first channel audio, that is, the size of the vector L, may be calculated by the equation $|L|=|M|\times\cos(\theta_m)\times\cos(\pi/12)$. Here, $|M|$ is the intensity of mono-audio, that is, the size of the vector M. If the unnormalized angle $\theta_0$ is set to 60°, and the angle between the vector L and the vector L' and the angle between the vector R and the vector R' are equal, then the angle between the vector L and the vector L' is 15°. Likewise, the intensity of the second channel audio, that is, the size of the vector R, may be calculated by an equation that $|R|=|M|\times\sin(\theta m)\times\cos(\pi/12)$. Here, the angle between the vector R and the vector R' is 15°.

The phases of the first and second channel audios in the sub-band k may be calculated from the phase difference between the first and second channel audios. When the stereo audio is encoded by generating the phase-adjusted second channel audio by adjusting the phase of the second channel audio to be the same as the phase of the first channel audio, and mono-audio by adding the phase-adjusted second channel audio and the first channel audio, the phases of the first and second channel audios may be restored with only the information on the phase difference.

Since the phase of the mono-audio generated by adding the first channel audio and the phase adjusted second channel audio is the same as that of the first channel audio, the phase of the first channel audio may be easily obtained from the phase of the mono-audio decoded by the mono-audio decoding unit 630. The phase of the second channel audio may be obtained by reflecting the phase difference. Thus, since all information on the intensities and phases of the first and second channel audios are restored, the stereo audio may be restored.

In the stereo audio encoding apparatus 100, as described above, the method of decoding the information for determining the intensities of the first and second channel audios in the sub-band k using the vectors and the method of decoding the information for determining the phases of the first and second channel audios in the sub-band k using the phase adjustment may be used independently or in a combination.

The D/A converting unit 650 converts the first and second channel audios restored by the audio restoration unit 640 to analog signals and outputs the converted signals.

Figure 7:
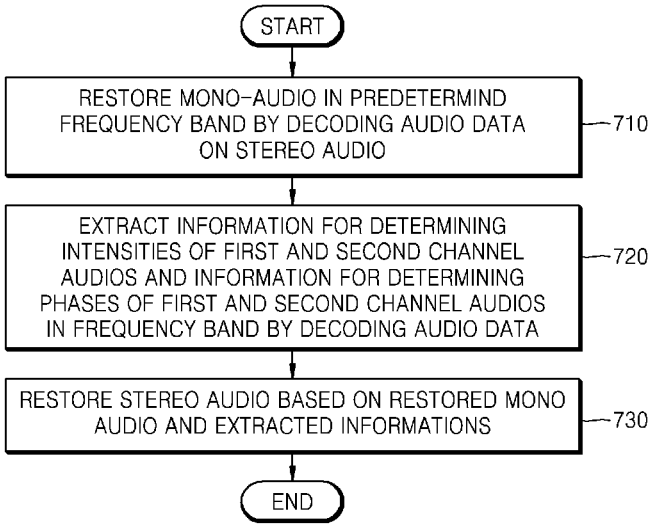
FIG. 7 is a flowchart for explaining a method of decoding stereo audio according to an embodiment of the present invention.

FIG. 7 is a flowchart for explaining a method of decoding stereo audio according to an embodiment of the present invention. Referring to FIG. 7, in Operation 710, the stereo audio decoding apparatus 600 decodes audio data about the stereo audio and restores the mono-audio in the sub-band k. The bit stream of the mono-audio included in the bit stream of the audio data is extracted and the bit stream of the extracted mono-audio is decoded so that the mono-audio is restored.

In Operation 720, the stereo audio decoding apparatus 600 decodes audio data of the stereo audio to decode the parameters of the stereo audio. The parameters of the stereo audio include the information for determining the intensities of the first and second channel audios in the sub-band k and the information for determining the phases of the first and second channel audios in the sub-band k.

According to the present embodiment, the information for determining the intensities of the first and second channel audios is generated based on the vector on the intensity of the first channel audio and the vector on the intensity of the second channel audio in the sub-band k. In the vector space shown in FIG. 3A, for example, a vector space is generated such that the vector L on the intensity of the first channel audio and the vector R on the intensity of the second channel audio make a predetermined angle. The information on the angle between the vector L and the vector M on the intensity of the mono-audio, or the angle between the vector R and the vector M, in the generated vector space is decoded. The information on the decoded angle may be information on an angle obtained by normalizing the angle between the vector L and the vector M or the angle between vector R and vector M. Also, the information on the cosine value of the angle between the vector L and the vector M or the cosine value on the angle between the vector R and the vector M may be decoded.

According to the present embodiment, the information for determining the phases of the first and second channel audios is information on the phase difference between the first and second channel audios in the sub-band k. When the mono-audio decoded in Operation 710 is mono-audio generated by adding the first audio and the phase-adjusted second channel audio, the phases of the first audio and the original second channel audio may be calculated by decoding only the information on the phase difference between the first audio and the original second channel audio.

In Operation 730, the stereo audio decoding apparatus 600 restores the stereo audio based on the information extracted in Operation 720 and the mono-audio decoded in Operation 710. The mono-audio restored in Operation 710 is converted to stereo audio based on the parameters of the stereo audio extracted in Operation 720.

According to the present invention, in the encoding of the stereo audio, since the number of the parameters on the intensity is reduced, the stereo audio may be compressed at a higher compression ratio. Also, according to the present invention, in the encoding of the stereo audio, since the number of the parameters on the phase is reduced, the stereo audio may be compressed at a higher compression ratio.

While this invention has been particularly shown and described with reference to exemplary embodiments thereof, it will be understood by those skilled in the art that various changes in form and details may be made therein without departing from the spirit and scope of the invention as defined by the appended claims. Also, the invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, and optical data storage devices. The computer readable recording medium can also be distributed over network coupled computer systems so that the computer readable code is stored and executed in a distributed fashion.

Also, the invention can also be embodied as computer readable codes on a computer transmissible medium, such as carrier waves and data transmission through the Internet.

What is claimed is:

1. A method of encoding stereo audio, the method comprising:

generating a vector space in which a first vector on an intensity of a first channel audio in a frequency band and a second vector on an intensity of a second channel audio in the frequency band make a predetermined angle;

generating a third vector on an intensity of a mono-audio by adding the first and second vectors in the vector space;

encoding the mono-audio; and encoding information for determining intensities of the first and second channel audios in the frequency band, wherein the encoding information for determining intensities comprises encoding information on an angle between the third vector and the first vector or an angle between the third vector and the second vector in the vector space.

2. The method of claim 1, further comprises:

generating a phase-adjusted second channel audio by adjusting a phase of the second channel audio such that a phase of the first channel audio and the phase of the second channel audio are the same in a predetermined frequency band;

generating the mono-audio by adding the first channel audio and the phase-adjusted second channel audio; and encoding information on a phase difference between the first and second channel audios in the frequency band, wherein a phase of the mono-audio is same with the phase of the first channel audio and a phase of the phase-adjusted second channel audio.

3. The method of claim 1, wherein the encoding of the information on the angle comprises encoding a cosine value of the angle between the third vector and the first vector or a cosine value of the angle between the third vector and the second vector.

4. A non-statutory computer-readable recording medium having recorded thereon a program to execute a method defined in claim 1.

5. A method of encoding stereo audio, the method comprising:

generating information on an angle between a first vector on an intensity of a first channel audio in a frequency band and a third vector on an intensity of mono-audio or an angle between a second vector on an intensity of a second channel audio in the frequency band and the third vector in a vector space in which the first vector and the second vector make a predetermined angle; and encoding the stereo audio based on the mono-audio and the information on an angle, wherein the third vector is generated by adding the first and second vectors in the vector space, and wherein the mono-audio is generated by adding the first channel audio and a phase-adjusted second channel audio whose phase is adjusted to be the same as the phase of the first channel audio, and wherein a phase of the mono-audio is same with the phase of the first channel audio and a phase of the phase-adjusted second channel audio.

6. The method of claim 5, wherein the information on an angle is a cosine value of the angle between the third vector and the first vector or a cosine value of the angle between the third vector and the second vector.

7. The method of claim 6, wherein the encoding of the stereo audio comprises:

encoding the mono-audio;

encoding the information on an angle; and encoding information on a phase difference between the first and second channel audios in the frequency band.

8. A non-statutory computer-readable recording medium having recorded thereon a program to execute a method defined in claim 5.

9. An apparatus for encoding stereo audio comprising:

an encoding unit which encodes the stereo audio based on a mono-audio, wherein the encoding unit comprises:

a mono-audio encoding unit which encodes the mono-audio; and a parameter encoding unit which generates a vector space in which a first vector on an intensity of a first channel audio in the frequency band and a second vector on an intensity of a second channel audio in the frequency band make a predetermined angle, generate a third vector on an intensity of the mono-audio by adding the first and second vectors in the vector space, and encode information for determining intensities of the first and second channel audios, wherein the information for determining intensities comprising information on an angle between the third vector and the first vector or an angle between the third vector and the second vector in the vector space, and wherein the encoding unit is implemented as a hardware component.

10. The apparatus of claim 9, wherein the:

parameter encoding unit encodes information for determining the phase difference between the first and second channel audios in the frequency band.

11. The apparatus of claim 9, further comprising:

a downmix unit which generates a phase-adjusted second channel audio by adjusting a phase of the second channel audio to be the same as a phase of the first channel audio in a predetermined frequency band and generating mono-audio by adding the first channel audio and the phase-adjusted second channel audio, and wherein an encoding unit which encodes the stereo audio based on information on a phase difference between the first and second channel audios in the frequency band and the mono-audio, wherein a phase of the mono-audio is same with the phase of the first channel audio and a phase of the phase-adjusted second channel audio, and wherein the downmix unit is implemented as a hardware component.

12. An apparatus for encoding stereo audio comprising:

a downmix unit which generates mono-audio by adding first and second channel audios in a predetermined frequency band;

a parameter encoding unit which encodes information on an angle between a first vector on an intensity of the first channel audio in the frequency band and a third vector on an intensity of the mono-audio or an angle between a second vector on the intensity of the second channel audio in the frequency band and the third vector in a vector space in which the first vector and the second vector make a predetermined angle; and a mono-audio encoding unit which encodes the mono-audio, wherein the third vector is generated by adding the first and second vectors in the vector space, and wherein the downmix unit generates the mono-audio by adding the first channel audio and a phase-adjusted second channel audio whose phase is adjusted to be the same as the phase of the first channel audio, and wherein a phase of the mono-audio is same with the phase of the first channel audio and a phase of the phase-adjusted second channel audio, and wherein at least one of the downmix unit, the parameter encoding unit, and the mono-audio encoding unit is implemented as a hardware component.

13. The apparatus of claim 12, wherein the information on an angle is a cosine value of the angle between the third vector and the first vector or a cosine value of the angle between the third vector and the second vector.

* * * * *